United States Patent [19]

Spencer

[11] 4,078,557

[45] Mar. 14, 1978

[54] HAIR WASHING DEVICE

[75] Inventor: Anita J. Spencer, St. Paul, Minn.

[73] Assignee: The Raymond Lee Organization, Inc., New York, N.Y.

[21] Appl. No.: 744,718

[22] Filed: Nov. 24, 1976

[51] Int. Cl.[2] ..... A61H 7/00; A61H 9/00

[52] U.S. Cl. ..... 128/56; 128/65; 4/159

[58] Field of Search ..... 128/65, 66, 56; 4/159

[56] References Cited

U.S. PATENT DOCUMENTS

| | | | |
|---|---|---|---|
| 2,729,823 | 1/1956 | Foster | 4/159 |
| 2,813,275 | 11/1957 | Davenport | 4/159 |
| 2,854,969 | 10/1958 | Nolan | 128/65 |
| 3,343,530 | 9/1967 | Solos et al. | 128/65 |

*Primary Examiner*—Lawrence W. Trapp
*Attorney, Agent, or Firm*—Daniel Jay Tick

[57] ABSTRACT

A helmet has ear plugs to cover the ears of a wearer and an watertight band lining the helmet to prevent fluid leakage therefrom. A flexible inlet hose opens into the helmet for supplying water under pressure into the helmet. A flexible outlet hose extends from the helmet for draining fluid therefrom via a drain valve. A spray device in the helmet at the opening of the inlet hose sprays water into the helmet via a water valve. A reservoir of hair shampoo fluid opens into the helmet via a shampoo valve. A plurality of scalp massaging brushes are rotatably mounted in the helmet. A motor is mounted in the helmet and coupled to the brushes for rotating the brushes. A rechargeable battery is mounted in the helmet. A control device is electrically connected to the motor and the battery for selectively operating the water valve, the shampoo valve, the drain valve and the motor in a predetermined sequence to wet, shampoo, brush, rinse and drain the hair of a wearer of the helmet.

2 Claims, 4 Drawing Figures

HAIR WASHING DEVICE

BACKGROUND OF THE INVENTION

The present invention relates to a hair washing device.

Objects of the invention are to provide a hair washing device of simple structure, which is inexpensive in manufacture, used with facility and convenience, and avoids the need for bending over a tub in order to wash one's hair, similarly avoiding the need to take a shower in order to wash one's hair, said hair washing device permitting a user to wash his or her hair whenever desired, while seated, reclining or upright, as desired.

BRIEF DESCRIPTION OF THE DRAWINGS

In order that the invention may be readily carried into effect, it will now be described with reference to the accompanying drawings, wherein.

DETAILED DESCRIPTION OF THE INVENTION

Figure 1:
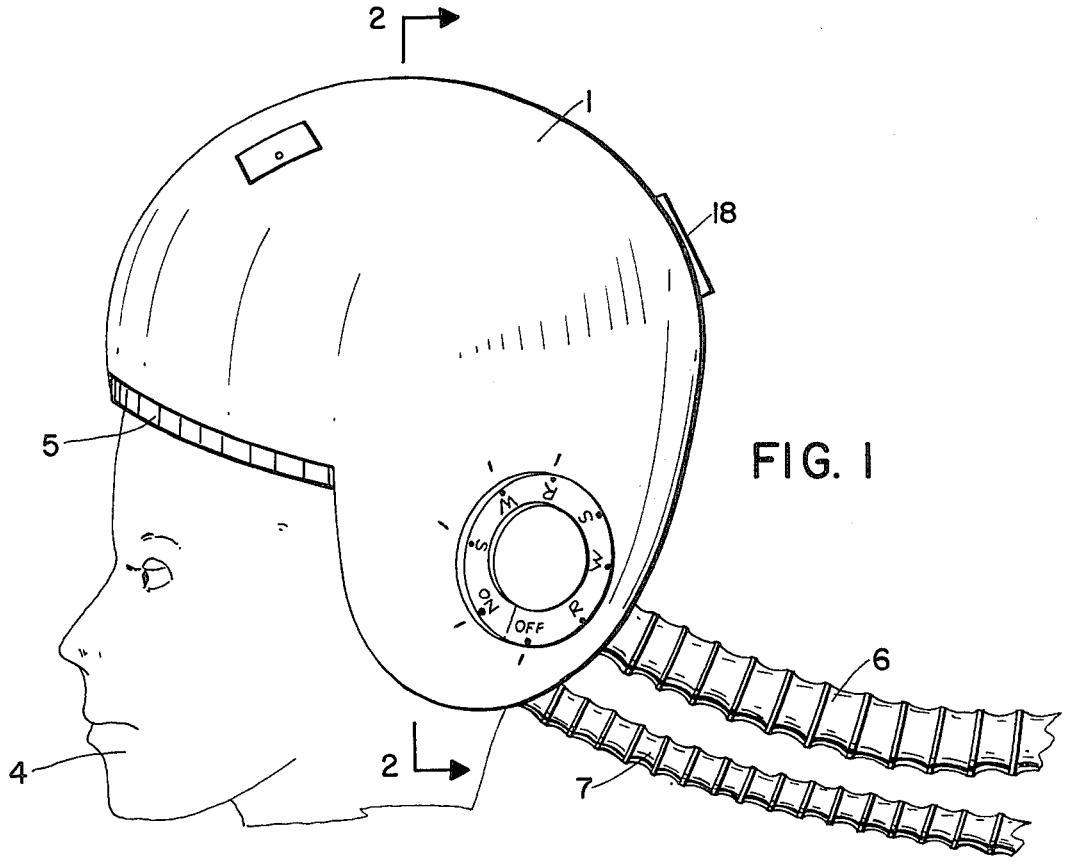
FIG. 1 is a view of the helmet and some of the components of an embodiment of the hair washing device of the invention.

The hair washing device of the invention comprises a helmet 1 (FIGS. 1 to 3) having ear plugs, flaps, or the like, 2 and 3 (FIG. 2) to cover the ears of a wearer 4 (FIG. 1) and a watertight band 5 (FIGS. 1 and 3) lining the helmet to prevent fluid leakage from the helmet. The ear plugs or flaps 2 and 3 are preferably removably affixed within the helmet 1.

A flexible inlet hose 6 of any suitable known type (FIGS. 1 and 3) opens into the helmet 1 for supplying water under pressure into said helmet. A flexible outlet hose 7 of any suitable known type (FIGS. 1 and 3) extends from the helmet for draining fluid therefrom via a drain valve 8 (FIG. 3).

Figure 3:
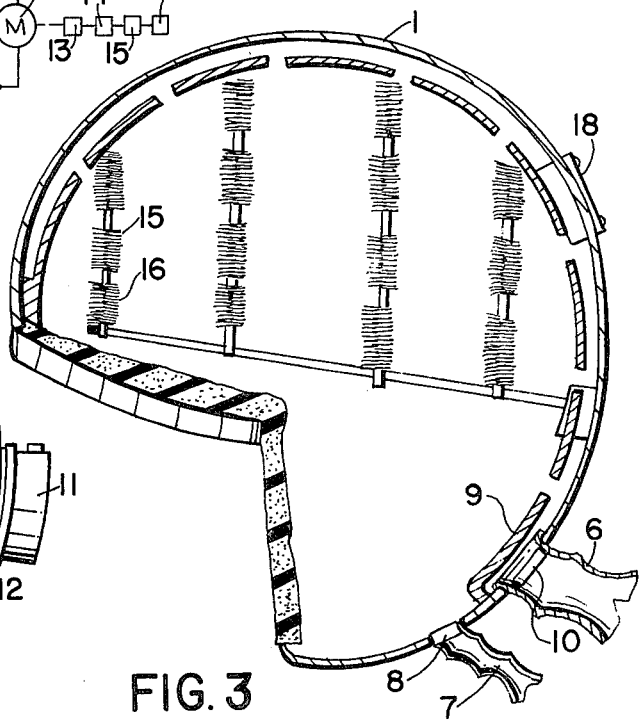
FIG. 3 is a cross-sectional view, taken in a plane perpendicular to that of the view of FIG. 2.

A spray device 9 (FIG. 3) is mounted in the helmet at the opening of the inlet hose 6 for spraying into the helmet via a water valve 10 (FIG. 3).

Figure 2:
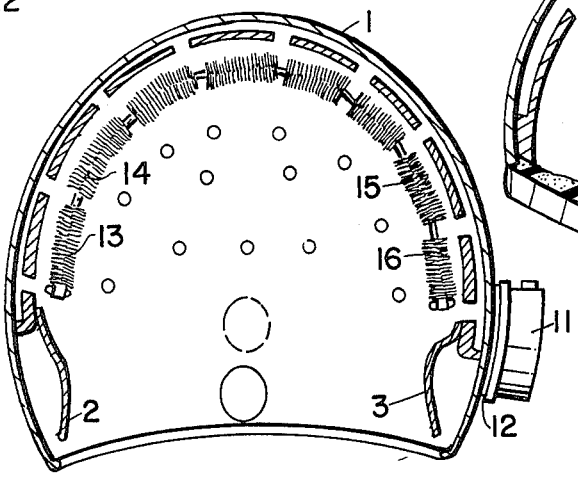
FIG. 2 is a cross-sectional view of the embodiment of FIG. 1, taken along the lines II—II, of FIG. 1.

A reservoir 11 of hair shampoo fluid opens into the helmet via a shampoo valve 12 (FIG. 2).

A plurality of scalp massaging brushes 13, 14, 15, 16, and so on (FIGS. 2, 3 and 4), are rotatably mounted in the helmet 1. The brushes are removably mounted and are sensitive to soft scalps. Brittle brushes are used on coarse scalps.

A miniature electric motor 17 (FIG. 1) is mounted in the helmet and coupled to the brushes 12 to 16, and so on, for rotating said brushes.

A rechargeable battery or batteries 18 (FIGS. 1, 3 and 4) is or are mounted in the helmet 1.

Figure 4:
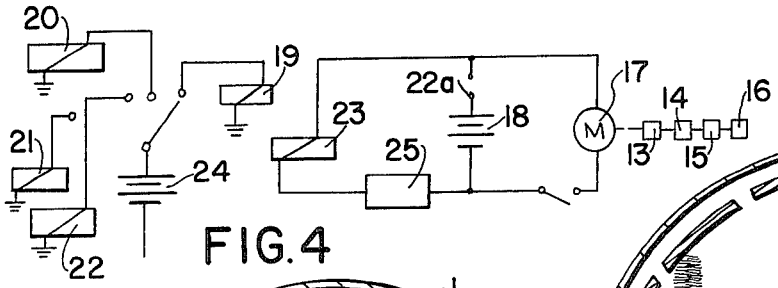
FIG. 4 is a circuit diagram of the hair washing device of the invention.

A control device, of the same type as a dishwasher or washing machine, is electrically connected to the motor 17 and the battery 18, as shown in FIG. 4. The control device includes a plurality of relays 19, 20, 21 and 22, as shown in FIG. 4. The relay 19 controls the water valve 10, the relay 20 controls the shampoo valve 12, the relay 21 controls the drain valve 8 and the relay 22 controls the motor 17 via a relay switch 22*a* controlled thereby. The control device further comprises a master stepping relay 23 for sequentially energizing the plurality of relays 19 to 22 via a battery 24, as shown in FIG. 4. A timer 25 of any suitable type controls the operation of the stepping relay 23, as shown in FIG. 4. The control device thus selectively operates the water valve 10, the shampoo valve 12, the drain valve 8 and the motor 17 in a predetermined sequence to wet, shampoo, brush and rinse the hair of the wearer 4 of the helmet 1 and to then drain the fluids from the helmet. The cycle may be repeated as often as desired in whole or in part.

While the invention has been described by means of a specific example and in a specific embodiment, I do not wish to be limited thereto, for obvious modifications will occur to those skilled in the art without departing from the spirit and scope of the invention.

I claim:

1. A hair washing device, comprising
   - a helmet having ear plugs to cover the ears of a wearer and a watertight band lining the helmet to prevent fluid leakage from the helmet;
   - a flexible inlet hose opening into the helmet for supplying water under pressure into the helmet;
   - a flexible outlet hose extending from the helmet for draining fluid therefrom via a drain valve;
   - spray means in the helmet at the opening of the inlet hose for spraying water into the helmet via a water valve;
   - a reservoir of hair shampoo fluid opening into the helmet via a shampoo valve;
   - a plurality of scalp massaging brushes rotatably mounted in the helmet;
   - motor means mounted in the helmet and coupled to the brushes for rotating said brushes;
   - rechargeable battery means mounted in the helmet; and
   - control means electrically connected to the motor means and the battery means for selectively operating the water valve, the shampoo valve, the drain valve and the motor means in a predetermined sequence to wet, shampoo, brush, rinse and drain the hair of a wearer of the helmet.

2. A hair washing device as claimed in claim 1, wherein the control means includes a plurality of relays each for controlling a corresponding one of the valves, a master stepping relay for sequentially energizing the plurality of relays and timer means for controlling the operation of the stepping relay.

* * * * *